US009303351B2

(12) United States Patent
Jun et al.

(10) Patent No.: US 9,303,351 B2
(45) Date of Patent: Apr. 5, 2016

(54) WASHING MACHINE

(75) Inventors: Cha-Seung Jun, Seoul (KR); Byoung-Wook Min, Seoul (KR); Dong-Cheol Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 841 days.

(21) Appl. No.: 13/124,327

(22) PCT Filed: Oct. 23, 2009

(86) PCT No.: PCT/KR2009/006163

§ 371 (c)(1),
(2), (4) Date: Apr. 14, 2011

(87) PCT Pub. No.: WO2010/047563

PCT Pub. Date: Apr. 29, 2010

(65) Prior Publication Data

US 2011/0197637 A1 Aug. 18, 2011

(30) Foreign Application Priority Data

Oct. 23, 2008 (KR) ..... 10-2008-0104442

(51) Int. Cl.

| | |
|---|---|
| ***D06F 21/00*** | (2006.01) |
| ***D06F 37/20*** | (2006.01) |
| ***D06F 37/04*** | (2006.01) |
| ***D06F 37/30*** | (2006.01) |

(52) U.S. Cl.

CPC ..... *D06F 37/206* (2013.01); *D06F 37/04* (2013.01); *D06F 37/30* (2013.01)

(58) Field of Classification Search

CPC ..... D06F 37/04; D06F 37/30; D06F 37/206
USPC ..... 68/3 R, 140
See application file for complete search history.

(56) References Cited

U.S. PATENT DOCUMENTS

| | | | | |
|---|---|---|---|---|
| 6,460,382 | B1 * | 10/2002 | Kim et al. | 68/140 |
| 7,166,950 | B2 * | 1/2007 | Kim et al. | 310/261.1 |
| 7,168,118 | B2 * | 1/2007 | Kim et al. | 8/159 |
| 7,305,857 | B2 * | 12/2007 | Kim et al. | 68/58 |
| 2002/0000108 | A1 | 1/2002 | Heyder et al. | |
| 2005/0146235 | A1 * | 7/2005 | Kim et al. | 310/67 R |
| 2006/0150687 | A1 * | 7/2006 | Chang et al. | 68/24 |
| 2006/0230618 | A1 * | 10/2006 | Kim et al. | 29/898.07 |
| 2007/0017261 | A1 * | 1/2007 | Chang et al. | 68/23.1 |
| 2007/0113598 | A1 * | 5/2007 | Jun et al. | 68/140 |
| 2007/0138902 | A1 * | 6/2007 | Ahn et al. | 310/261 |

FOREIGN PATENT DOCUMENTS

| | | | |
|---|---|---|---|
| CN | 1924159 | A | 3/2007 |
| EP | 1 655 406 | A2 | 5/2006 |
| EP | 1 760 185 | A2 | 3/2007 |

(Continued)

*Primary Examiner* — Michael Barr
*Assistant Examiner* — Benjamin L Osterhout
(74) *Attorney, Agent, or Firm* — Dentons US LLP

(57) ABSTRACT

A washing machine includes: a main body forming an external appearance; a tub installed at an inner side of the main body and keeping washing water in storage; a drum rotatably installed at the inner side of the tub; a rotational shaft coupled with the drum to transfer a driving force; a driving motor installed between the tub and the drum to rotate the rotational shaft; and a gasket installed between the drum and the tub and preventing leaked washing water from being introduced to the driving motor.

5 Claims, 3 Drawing Sheets

(56) References Cited

FOREIGN PATENT DOCUMENTS

| | | | |
|---|---|---|---|
| JP | 2005-034673 | A | 2/2005 |
| KR | 10-2006-0031273 | | 4/2006 |
| KR | 10-2006-0089580 | | 8/2006 |
| KR | 10-0662150 | B1 | 12/2006 |
| KR | 100662150 | B1 | 12/2006 |

* cited by examiner

WASHING MACHINE

This application is a 35 U.S.C. §371 National Stage entry of International Application No. PCT/KR2009/006163, filed on Oct. 23, 2009, which claims the benefit of the earlier filing date and right of priority to Korean Application No. 10-2008-0104442, filed Oct. 23, 2008, the contents of which are hereby incorporated by reference herein in their entirety.

TECHNICAL FIELD

The present invention relates to a washing machine and, more particularly, to a washing machine in which a driving motor for rotating a drum is disposed at an inner side of a washing machine tub.

BACKGROUND ART

In general, a washing machine is a device in which in a state that washing water is supplied to the interior of a drum in which the laundry has been input to be placed, the drum is rotated in a forward direction or in a backward direction to allow the laundry within the drum to collide with the washing water so as to wash dirt or stain off the laundry by using energy generated according to the collision between the laundry and the washing water.

FIG. 1 illustrates the configuration of a general washing machine. As shown in FIG. 1, the general washing machine includes a main body 5, a tub 3 installed at the interior of the main body 5 and keeping washing water in storage, a drum 9 rotatably installed within the tub 3 and receiving the laundry inputted thereto, driving motors 130 and 140 configured to rotate the drum 9, a rotational shaft 150 configured to transfer a rotational force of the driving motors 130 and 140 to the drum 9, a bearing 11 supporting the rotational shaft 150, a detergent supply device 30 configured to supply water mixed with a detergent to the tub 3, a water supply device 20 including a plurality of valves for supplying water to the detergent supply device 30 or interrupting water supply to the detergent supply device 30, and a drain pump 40 configured to pump water stored in the tub 3 to drain it out. A stop spring 4 is installed between an inner side of an upper surface of the main body 5 and an upper side of an outer circumferential surface of the tub 3, supporting the tub 3, and a friction damper 10 is installed between an inner side of a lower surface of the main body 5 and a lower side of an outer circumferential surface of the tub 3, to attenuate vibration of the tub 3. A plurality of lifters 9*a* are installed at the inner side of the drum 9 in order to stir the laundry.

The driving motors 130 and 140 include a stator 130 and a rotor 140 having a permanent magnet and rotating on an outer circumferential surface of the stator 130. The stator 130 is fastened to a rear wall of the tub 3 and the rotor 140 is fastened to a rear end portion of the rotational shaft 150.

As shown, the driving motors 130 and 140 are disposed at an outer side of the tub 3 and rotate the drum installed at the inner side of the tub. Thus, the presence of the driving motors between the rear wall of the tub 3 and the rear surface of the main body hampers the use of the internal space of the main body 5 of the washing machine, resulting in the limitation in the floor area ratio of the tub 5 or the drum 9, namely, in the washing capacity allowed by the washing machine, when the size of the main body 5 is fixed. In addition, because the driving motor causing noise and vibration of the washing machine is exposed to outside, noise and vibration of the washing machine is further increased.

DISCLOSURE OF INVENTION

Solution to Problem

Therefore, an object of the present invention is to provide a washing machine in which the space within a drum is increased to increase a washing capacity and reduce vibration and noise of the washing machine.

To achieve these and other advantages and in accordance with the purpose of the present invention, as embodied and broadly described herein, there is provided a washing machine including: a main body forming an external appearance; a tub installed at an inner side of the main body and keeping washing water in storage; a drum rotatably installed at the inner side of the tub; a rotational shaft coupled with the drum to transfer a driving force; a driving motor installed between the tub and the drum to rotate the rotational shaft; and a gasket installed between the drum and the tub and preventing leaked washing water from being introduced to the driving motor.

With such configuration, because the driving motor is installed between the tub and the drum of the washing machine, vibration and noise according to a rotation of the driving motor can be prevented from being directly transferred to the exterior, and the washing capacity of the washing machine can be increased.

The driving motor may include: a stator having a winding part with coil wound thereon; and a rotor including a magnet positioned at an outer side of the stator and a rotor frame having the magnet positioned therein. The stator may be fastened to the tub by using a fastening member, and the rotor frame is fastened to the rotational shaft. The rotor frame may include a support member having a through hole in which the rotational shaft is inserted to be fastened and a side member extending from the support member in a perpendicular manner and having the magnet.

In order to smoothly transfer the driving force from the rotational shaft to the drum, a spider may be installed at a rear surface of the drum. The spider may include a circular plate having a protrusion formed at the center thereof to which the rotational shaft is fastened and an outer circumferential surface vertically extending from an outer circumference of the circular plate. The driving motor may be disposed in an accommodating space formed by the circular plate and the outer circumferential surface of the spider.

The spider may include a plurality of drum fastening parts provided on the outer circumferential surface thereof and fastened to the rear surface of the drum. The spider may be made of aluminum.

The gasket may include a central wall part having a through hole to which the protrusion of the spider is inserted and a side wall part vertically extending from an outer circumference of the central wall part. The driving motor may be accommodated in an internal space formed by the central wall part and the side wall part of the gasket. The side wall part of the gasket may have creases (i.e., depressed and protruded portions).

A sealing member may be provided between the through hole of the central wall part of the gasket and the protrusion of the spider in order to prevent washing water from infiltrating to the driving motor. The section of the sealing member may have a channel shape. Overall the sealing member may have an annular shape.

As mentioned above, the washing machine according to an exemplary embodiment of the present invention has the following advantages. That is, because the internal space of the washing machine main body is effectively utilized, the washing capacity of the interior of the drum can be increased. Also, because the driving motor, mainly causing vibration and noise of the washing machine, is rotated at the inner side of the tub, transfer of noise and vibration generated from the motor to the exterior can be reduced.

The foregoing and other objects, features, aspects and advantages of the present invention will become more apparent from the following detailed description of the present invention when taken in conjunction with the accompanying drawings.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODE FOR THE INVENTION

Reference will now be made in detail to the preferred embodiments of the present invention, examples of which are illustrated in the accompanying drawings.

Figure 1:
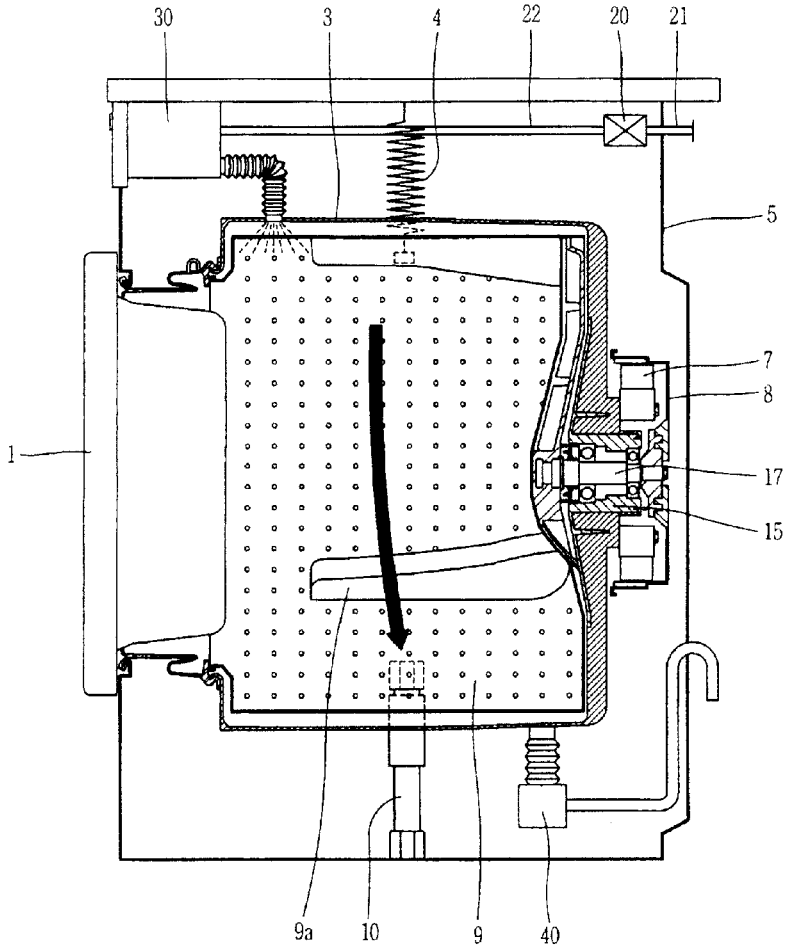
FIG. 1 is a vertical sectional view of a general washing machine.
Figure 2:
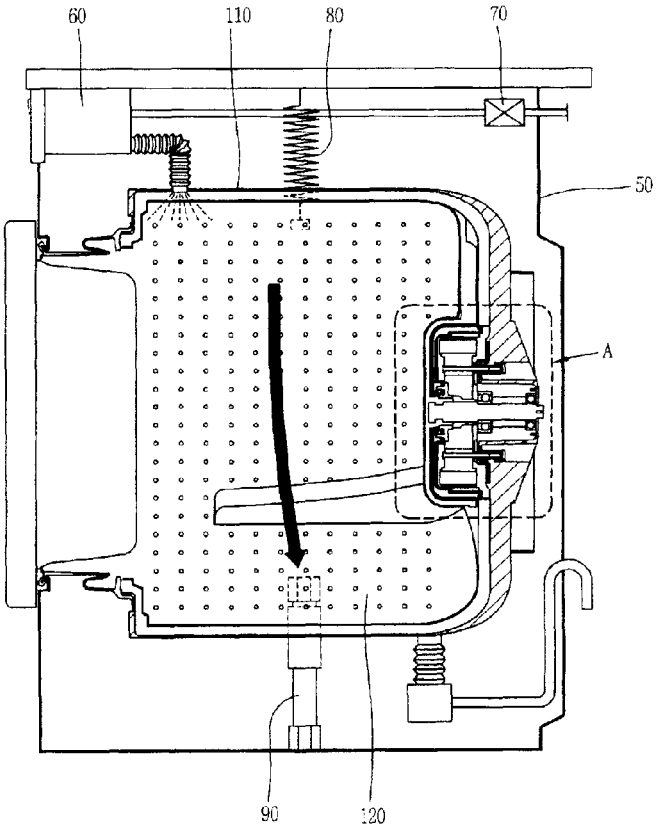
FIG. 2 is a vertical sectional view of a washing machine according to an exemplary embodiment of the present invention.

FIG. 2 is a vertical sectional view of a washing machine according to an exemplary embodiment of the present invention.

As shown in FIG. 2, the washing machine according to an exemplary embodiment of the present invention includes: a main body 50 forming an eternal appearance; a tub 110 installed at the interior of the main body 50 and keeping washing water in storage, a drum 120 rotatably installed within the tub 110 and receiving the laundry inputted thereto, driving motors 130 and 140 configured to rotate the drum 120, a rotational shaft 150 configured to transfer a rotational force of the driving motors 130 and 140 to the drum 120, bearings 161 and 163 supporting the rotational shaft 150, a detergent supply device 60 configured to supply water mixed with a detergent to the tub 110, and a water supply device 70 including a plurality of valves for supplying water to the detergent supply device 60 or interrupting water supply to the detergent supply device 60.

A stop spring 80 is installed between an inner side of an upper surface of the main body 50 and an upper side of an outer circumferential surface of the tub 110, supporting the tub 110, and a friction damper 90 is installed between an inner side of a lower surface of the main body 50 and a lower side of an outer circumferential surface of the tub 110, to attenuate vibration of the tub 110.

Figure 3:
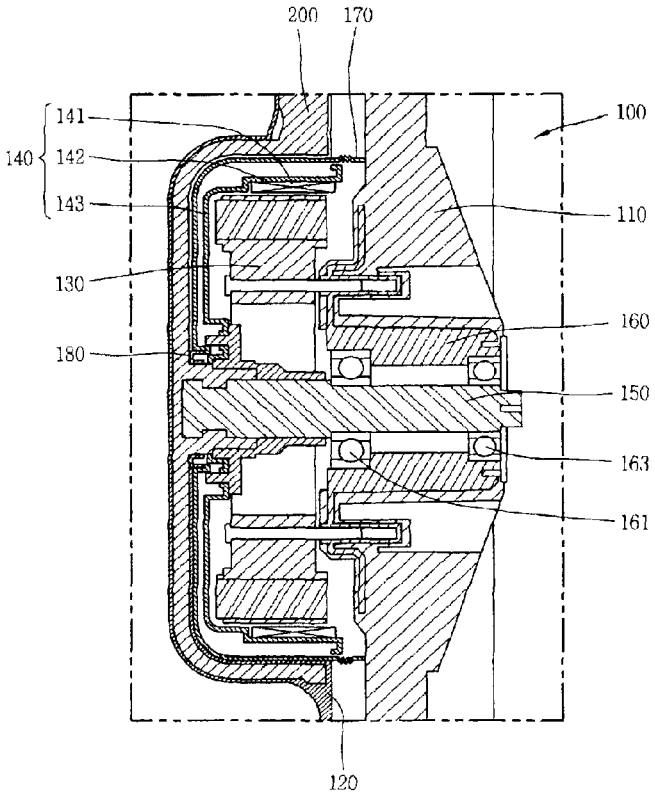
FIG. 3 is an enlarged view of a portion A in FIG. 2.

FIG. 3 is an enlarged view of a portion A in FIG. 2. As shown in FIG. 3, the driving motors 130 and 140 of the washing machine according to an exemplary embodiment of the present invention are installed between the tub 110 and the drum 120. Compared with the related art washing machine, it is noted that, provided that the size of the main body 50 of the washing machine according to an exemplary embodiment of the preset invention and that of the related art washing machine are the same, the size of the tub 110 and drum 120 accommodated within the main body 50 is larger. The results obtained from experimentation after manufacturing the washing machine show that the capacity of the drum 120, namely, the washing capacity, was increased by about 10%.

The washing machine according to an exemplary embodiment of the present invention will now be described in detail with reference to FIGS. 2 and 3. As shown in FIGS. 2 and 3, the driving motors 130 and 140, direct drive motors, include a stator 130 having a coil wound on a slot and a rotor 140 rotating on an outer circumferential surface of the stator 130. The rotor 140 includes a magnet 141 and rotor frames 142 and 143. The rotor frames 142 and 143 include a support member 143 having a through hole formed at a central portion thereof in which the rotational shaft 150 is insertedly fastened and a side member 142 vertically extending from the support member 143 and having the magnet 141 therein. The stator 130 is fixedly fastened to the rear surface of the tub 110 by using a fastening member, and the rotor frame 143 is fastened to the rotational shaft 150. The rotor frame 143 may be fastened between the rotational shaft 150 by the medium of a fastening member.

When power is supplied to the coil of the stator 130 fixed in the tub 110, the rotor 140 is rotated according to an interaction with the magnet 141 attached at the inner side of the rotor 140. A rotational force of the rotor 140 is transferred to the drum 140 through the rotational shaft 150. The rotational shaft 150 is mounted at and supported by the tub 110 by means of a bearing housing 160. The bearing housing 160 includes two bearings, namely, a front bearing 161 and a rear bearing 163.

A spider 200 may be provided on the rear surface of the drum 120 in order to smoothly transfer the rotational force of the rotational shaft 150 to the drum 120. Namely, the rotational force of the rotational shaft 150 is transferred to the spider 200 coupled to the rotational shaft, and then to the drum 120 coupled to the spider 200.

Figure 4:
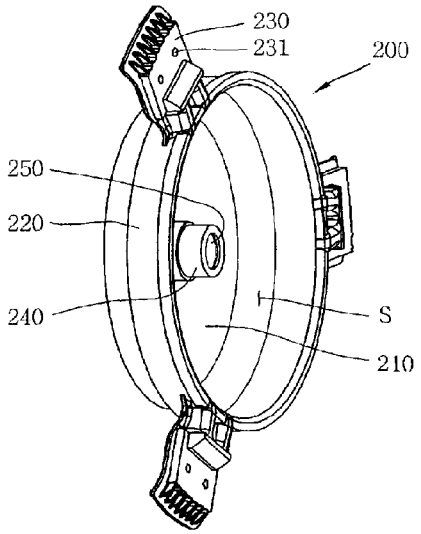
FIG. 4 is a perspective view of a spider according to an exemplary embodiment of the present invention.

In order to effectively couple the spider 200 to the drum 120, as shown in FIG. 4, the spider 200 may include a circular plate 210 having a protrusion 240 into which the rotational shaft 150 is insertedly fastened, and an outer circumferential surface 220 vertically extending from an outer circumference of the circular plate 210. The protrusion 240 includes a coupling recess 250 into which the rotational shaft 150 is inserted to be coupled.

Preferably, the rotational shaft 150 is injection-molded with the coupling recess 250 so as to be formed.

An internal space (S) formed by the circular plate 210 and the outer circumferential surface 220 accommodates the driving motors 130 and 140.

A plurality of drum fastening parts 230 are provided at the outer circumferential surface 220 of the spider 200 and fastened to the rear surface of the drum 120. The spider 200 and the drum 120 are coupled by using the drum fastened part 230. The drum fastening part 230 may have a fastening hole 231 into which a fastening member (not shown) is inserted in order to be coupled with the drum 120. Preferably, the spider 200 may be made of aluminum in order to have sufficient strength.

As for the fastening of the spider 200 to the drum 120, the rear surface of the drum 120 is coupled with the spider 200 from the left portion of the spider 200 shown in FIG. 4, and the driving motors 130 and 140 including the stator and the rotor of the washing machine are accommodated in the internal space (S) formed by the circular plate 210 and the outer circumferential surface 220 from the right side of the spider 200.

The coupling of the spider 200 to the rear surface of the drum 120 may be one of various exemplary embodiments of connecting the rotational shaft 150 to the drum 120, and the present invention is not limited thereto. That is, the rotational shaft 150 may be directly connected to the rear surface of the drum 120 without such a spider 200, or the spider 200 may be integrally formed with the drum 120.

During a washing process, washing water may exist between the drum 120 and the tub 110. In order to prevent washing water from infiltrating to the driving motors 130 and 140, in an exemplary embodiment of the present invention, a gasket 170 is installed to cover the driving motors 130 and 140. The gasket 170 has a similar shape to the spider 200, covering the stator 130 and the rotor 140.

Figure 5:
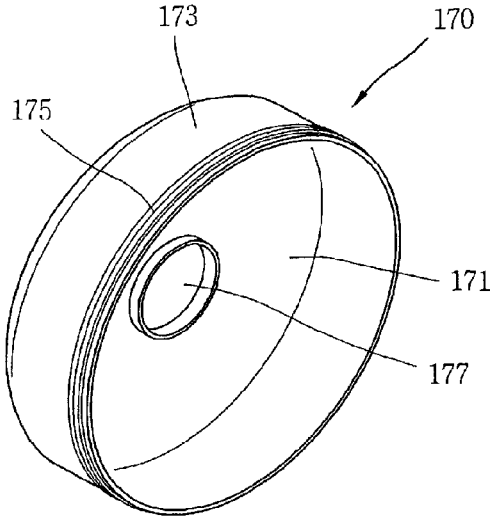
FIG. 5 is a perspective view of a gasket according to an exemplary embodiment of the present invention.

Namely, as shown in FIG. 5, the gasket 170 includes a central wall part 171 having a through hole 177 into which the protrusion 240 of the spider 200 is inserted and a side wall part 173 vertically extending from an outer circumference of the central wall part 171.

The driving motors 130 and 140 including the stator and the rotor are accommodated in an internal space formed by the central wall part 171 and the side wall part 173 of the gasket 170, so as to be protected against washing water.

The width of the side wall part 173 is sufficiently large so that the end of the side wall part 173 of the gasket 170 to be in contact with the tub 110, thereby preventing washing water from flowing to between the end of the side wall part 173 of the gasket 170 and the tub 110.

A crease 175 is formed substantially at the end of the side wall part 173 of the gasket 170, to more effectively prevent washing water from infiltrating to the driving motors 130 and 140.

The protrusion 240 of the spider 200 is inserted into the through hole 177 of the central wall part 171 of the gasket 170. In this case, there is a possibility that washing water infiltrates to the driving motors 130 and 140 through a gap between the through hole 177 and the protrusion 240. Thus, in order to prevent infiltration of washing water to the gap, in an exemplary embodiment of the present invention, a sealing member 180 in FIG. 3 is provided between the through hole 177 and the protrusion 240. The sealing member 180 has an annular shape overall so as to be inserted to the inner circumferential surface of the through hole 177. In the present exemplary embodiment, the sealing member 180 has a channel-shape section, but the present invention is not meant to be limited thereto. That is, the interior of the sealing member 180 may be hollow and the section of the sealing member 180 may have a square shape, or the interior of the sealing member 180 may be hollow and the section of the sealing member 180 may have a circular shape. The sealing member 180 may be made of a rubber material with good elasticity.

Figure 6:
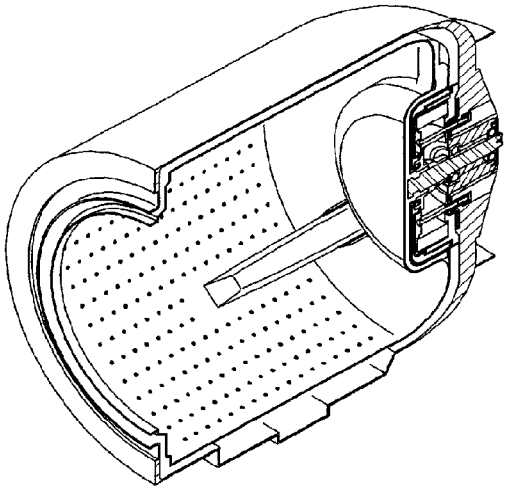
FIG. 6 is a sectional perspective view of a tub according to an exemplary embodiment of the present invention.

FIG. 6 is a perspective view showing the section of the interior of the washing machine according to an exemplary embodiment of the present invention. As shown in FIG. 6, the driving motors 130 and 140 are disposed between the drum 120 and the tub 110, and in order to accommodate the driving motors 130 and 140, the rear surface of the drum 120 is inwardly protruded.

In case of the washing machine according to an exemplary embodiment of the present invention, it is noted that, because the driving motors 130 and 140 are housed at the inner side of the tub 110, noise of the washing machine detected from the exterior is reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A washing machine comprising:

a main body forming an external appearance;

a tub installed at an inner side of the main body and keeping washing water in storage;

a drum rotatably installed at the inner side of the tub;

a rotational shaft coupled with the drum to transfer a driving force;

a driving motor installed between the tub and the drum to rotate the rotational shaft;

a spider coupled with the rotational shaft and a rear surface of the drum to transfer the driving force to the drum; and a gasket installed between the spider and the driving motor and preventing leaked washing water from being introduced to the driving motor, wherein the driving motor comprises:

a stator having a winding part with coil wound thereon; and a rotor including a magnet positioned at an outer side of the stator and a rotor frame having the magnet positioned therein, wherein the rotor frame comprises:

a support member having a through hole through which the rotational shaft is inserted to be fastened; and a side member extending from the support member in a perpendicular manner and covering an outer circumferential surface of the magnet, wherein the spider comprises:

a circular plate having a protrusion formed at the center thereof;

a coupling recess into which the rotational shaft is fixedly coupled, and formed at an inner circumferential surface of the protrusion;

an outer circumferential surface vertically extending from an outer circumference of the circular plate toward the tub; and a plurality of drum fastening parts protruded from the outer circumferential surface in a direction away from the rotational shaft, and fastened to the rear surface of the drum, wherein the gasket is accommodated in an accommodating space formed by the circular plate and the outer circumferential surface of the spider, wherein the gasket comprises:

a central wall part having a through hole into which the rotational shaft and the protrusion of the spider are inserted, and having a circular plate shape;

a side wall part vertically extending from an outer circumference of the central wall part to be in contact with the tub; and a crease formed at an outer circumference surface of the side wall part, wherein the driving motor is accommodated in a space formed by the central wall part and the side wall part.

2. The washing machine of claim 1, wherein the stator is fastened to the tub by using a fastening member, and the rotor frame is fastened to the rotational shaft.

3. The washing machine of claim 1, wherein the spider is made of aluminum.

4. The washing machine of claim 1, wherein a sealing member is provided at the through hole of the central wall part of the gasket in order to prevent washing water from infiltrating to the driving motor.

5. The washing machine of claim 4, wherein the sealing member has an annular shape with its section having a channel shape.

* * * * *